United States Patent [19]

Hoffman

[11] 4,344,543

[45] Aug. 17, 1982

[54] REINFORCED PLASTIC TANK

[75] Inventor: John J. Hoffman, South Bend, Ind.

[73] Assignee: Jackel, Inc., South Bend, Ind.

[21] Appl. No.: 161,056

[22] Filed: Jun. 19, 1980

[51] Int. Cl.[3] ..... B65D 90/02

[52] U.S. Cl. ..... 220/1 B; 52/247; 52/248; 52/249; 220/5 A; 220/71; 220/414; 220/453

[58] Field of Search ..... 220/1 B, 5 A, 18, 453, 220/414, 71, 3; 52/247, 248, 245, 249

[56] References Cited

U.S. PATENT DOCUMENTS

| | | | |
|---|---|---|---|
| 2,848,133 | 8/1958 | Ramberg | 220/3 |
| 2,903,877 | 9/1959 | Meade | 52/249 X |
| 3,025,992 | 3/1962 | Humphrey | 220/71 X |
| 3,203,845 | 8/1965 | Short | 220/3 X |
| 3,296,802 | 1/1967 | Williams | 220/3 X |
| 3,368,708 | 2/1968 | Pflederer | 220/3 |
| 3,545,640 | 12/1970 | Delahunt et al. | 220/5 A |

OTHER PUBLICATIONS

Light-Weight Sewage Ejector Basin with Cast Iron Hubs by Jackel.

*Primary Examiner*—Allan N. Shoap
*Attorney, Agent, or Firm*—Marmaduke A. Hobbs

[57] ABSTRACT

A reinforced plastic tank and method for producing the same, in which a steel plate base is provided for minimizing the bottom deflection of the tank under hydrostatic pressure when buried under ground. The base has a plate member with an annular flange extending outwardly from the top surface thereof. A plastic cup is disposed within the area surrounded by the flange, and an epoxy adhesive is injected between the cup and the steel plate and flange to adhere the cup to the steel. The side wall of the cup extends past the edge of the flange. The base assembly is then mounted on a mandrel and the fiberglass side wall is formed over the steel flange and the exposed side wall of the cup, and extends from the steel base to the desired height of the tank.

8 Claims, 3 Drawing Figures

10
40
40
38
16
40
14
32
12
34
36
3.
3.
21
18
2.

REINFORCED PLASTIC TANK

Underground tanks are used for many purposes, including fluid storage, sewage and waste water handling, and the like. Metal is often used for the construction of underground tanks; however, certain physical characteristics often make steel or other metals less than ideally suited for the conditions under which the tank will be used. Metals are subject to corrosion and rusting, and after prolonged underground use, a metal tank may corrode to the point of being unusable, hence requiring periodic replacement. Typically, metals have substantially equal strengths in all directions; however, as a result of the shape of the tank and the installation conditions, the stress exerted on a tank may not be equal in all directions. Hence, a metal tank built to withstand the maximum pressure exerted from the direction of principal stress will have unused available strength in the other directions. In effect, a metal tank must be "overbuilt" in some aspects to be only adequate in others. Other disadvantages of metal tanks include their weight in comparison to their size which makes installation and handling difficult, especially for large tanks, and their electrical and thermal conductivity which also may make a metal tank less than ideal for some uses.

As a result of the physical characteristic inadequacies of metal tanks, the cost for producing them, and the difficulties encountered in handling large metal tanks, alternative materials have been used in constructing underground storage vessels. Filament wound, plastic tanks have been found to be an economical alternative to metal tanks, and to offer a number of physical characteristic advantages as well. The glasss filaments used for reinforcing the tank walls possess perfect elastic behavior up to their rupture point, thus making possible accurate calculations of their response to stress. The resins used to bind the filaments distribute the forces exerted upon the tank evenly among the filaments, and hold the filaments in proper position to bear the load. Selective directional strength for the completed tank can be achieved by selecting the proper winding angle and pattern of the glass filaments; hence, the directional strength properties of the tank can be selected to match the specific requirements for the use to which the tank will be put. Thus, a tank which will be installed in normally wet grounds at or below the water table level can be wound to have greater hoop strength than a tank which will be used in drier soils and will not be subject to the same stress as the first mentioned tank. Fiberglass tanks possess other physical characteristics which make their use particularly advantageous in many applications. A fiberglass tank is resistant to chemical attack, will not rust or corrode, is impact and shatter resistant, non-magnetic, and has low thermal conductivity. Fiberglass tanks are also lightweight for their size when compared to metal tanks, making them easily transported and maneuvered prior to and during installation.

One of the principal difficulties associated with fiberglass tanks is that, although the side walls can be constructed to withstand crushing pressures, the bottom of the tank may tend to deflect or buckle inwardly when stress pressures are exerted on the side walls of the tank. The amount of deflection in small tanks, generally those less than two feet in diameter, is minimal and of little significance in the usefulness of the tank; however, larger tanks, generally those in excess of two feet in diameter, are subject to greater amounts of deflection, especially when the tank is buried below the water table so that hydrostatic pressure from the water-soaked ground is exerted on the side walls of the tank. The deflection of the tank bottom upwardly into the tank may be enough that the tank bottom will buckle, or pumps installed on the tank bottom may not operate properly or be misaligned with the fixtures and related equipment. It is therefore one of the principal objects of the present invention to provide a reinforced plastic tank having a bottom construction which will minimize deflection of the bottom even when a tank is used in wet ground and subjected to hydrostatic pressures, and which can be used on tanks of various sizes from relatively small diameter tanks to relatively large diameter tanks.

Another object of the present invention is to provide a reinforced plastic tank having a reinforced bottom which is easily adaptable to meet the physical conditions under which the tank will be used so that tanks may be fabricated differently when the tanks will be used in dry ground as compared to tanks to be used in wet ground, and to provide a tank which will weigh significantly less than comparable size tanks made entirely of steel.

A further object of the present invention is to provide a reinforced plastic tank having a steel plate bottom which is securely attached to the fiberglass tank and will remain bonded thereto throughout the life of the tank, and which is shielded from the interior of the tank, therefore being protected from corrosion caused by the contents of the tank.

A still further object of the present invention is to provide a method for quickly and efficiently attaching a steel plate to a plastic tank for reinforcing the bottom of the tank, providing a construction which will last throughout the useful life of the tank.

Additional objects and advantages of the present invention will become apparent from the following detailed description and the accompanying drawings wherein.

Figure 1:
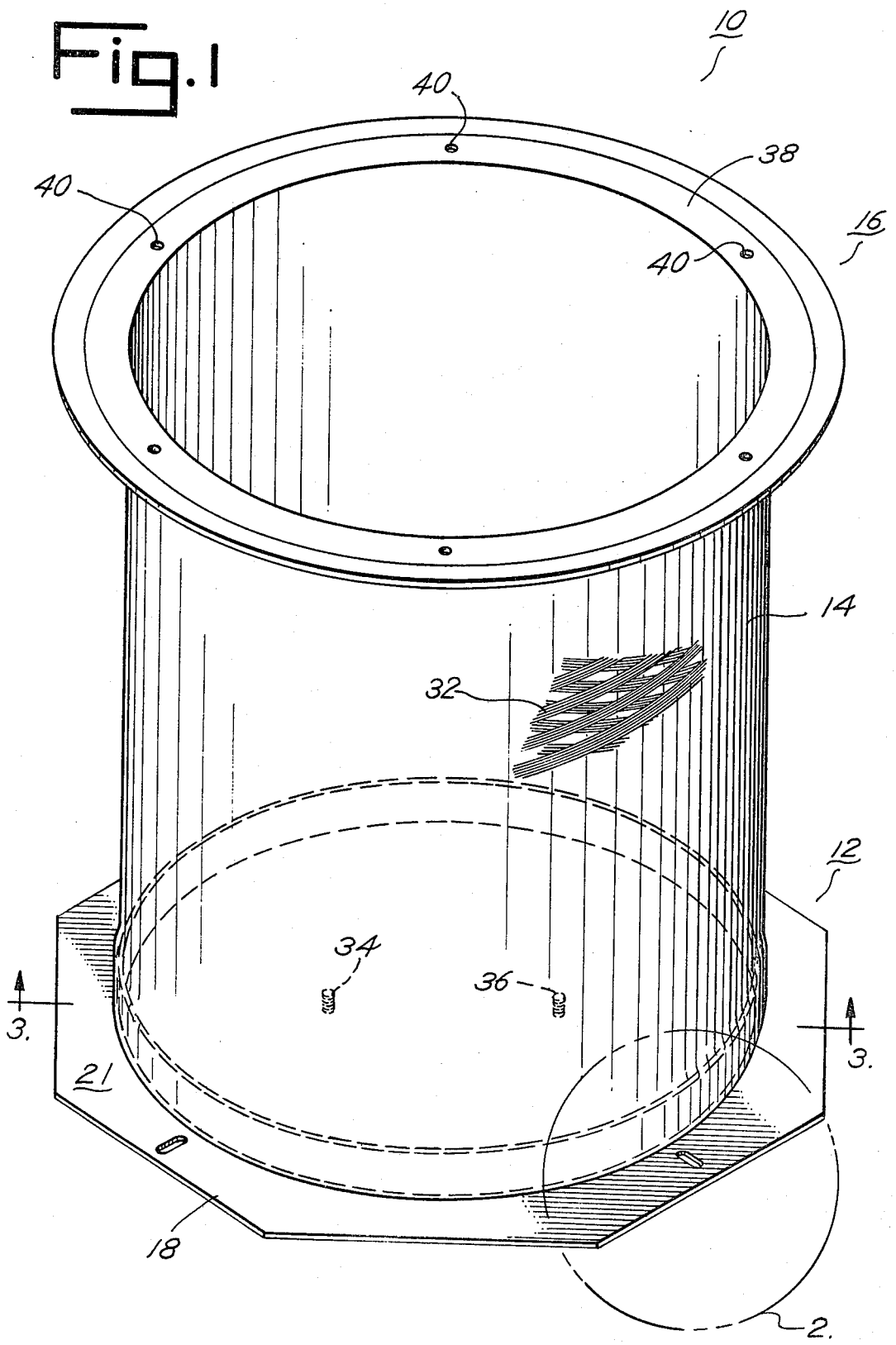
FIG. 1 is a perspective view of a reinforced plastic tank embodying the present invention.
Figure 2:
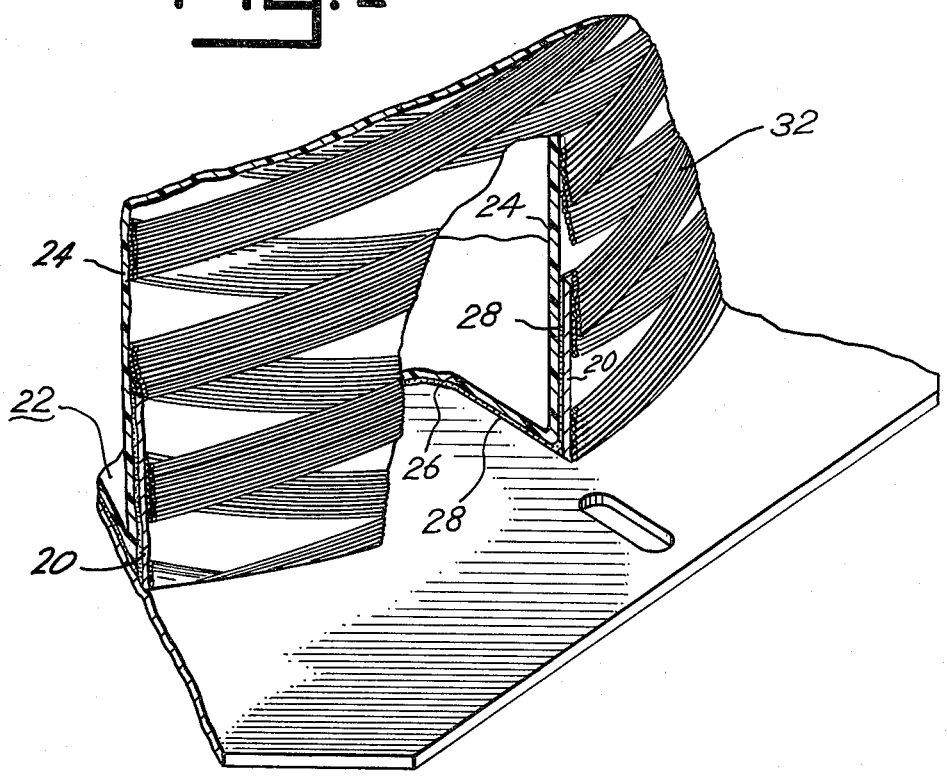
FIG. 2 is a perspective cut-away view of a portion of the reinforced plastic tank shown in FIG. 1, the portion being indicated on FIG. 1 by numeral 2.
Figure 3:
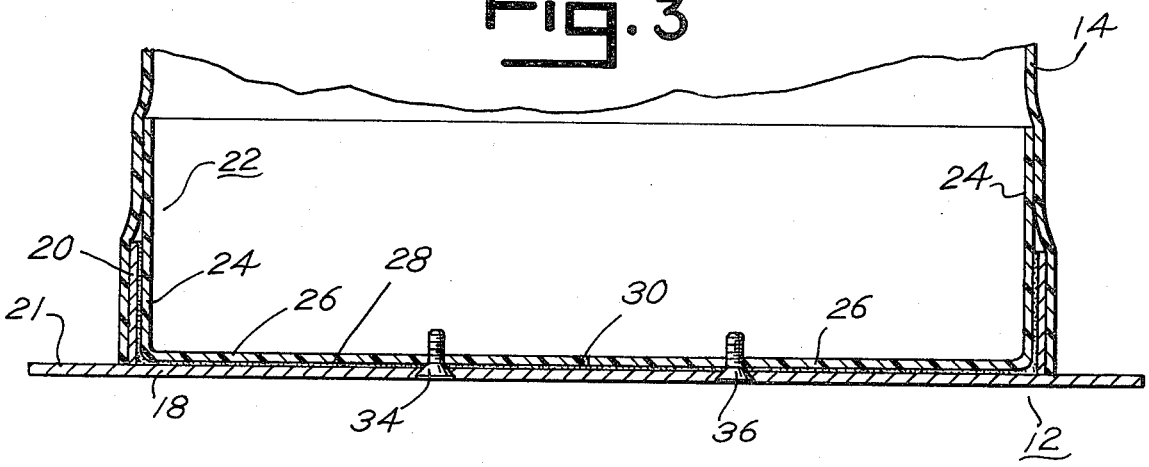
FIG. 3 is a fragmentary, vertical cross sectional view of the tank shown in FIG. 1 taken on line 3—3 of the latter figure.

Referring more specifically to the drawings and to FIG. 1 in particular, numeral 10 designates a reinforced plastic tank embodying the present invention which was fabricated using the method of the present invention, the tank having a base assembly 12, a tank wall 14, and a top flange assembly 16. Although the present reinforced plastic tank and method for the fabrication thereof may be used on tanks of virtually any size, under normal conditions it is not necessary to use a reinforced base assembly for relatively small tanks, of two feet or less in diameter, and normally the present invention will be used only for larger embodiments.

Base assembly 12 includes a metal plate 18, which may be of steel or other substantially rigid material, and an annular flange 20 of similar material extending perpendicularly from the upper surface of the plate and attached to the plate normally by welding. The flange is positioned inwardly from the edge of the plate, leaving an extension 21 of the plate disposed laterally outwardly from tank wall 14, for assisting in retaining the tank in the desired position in the ground. The thickness of the plate and flange may be varied to reduce the actual tank bottom deflection to the desired maximum amount. Hence, a thicker plate will be used for tanks of larger diameter than for tanks of smaller diameter for limiting the maximum deflection to acceptable amounts. The thickness of the plate may also be varied in accordance with the anticipated stress to be exerted on the tank. For example, a tank to be used in dry soil may not require as thick a plate and flange as a tank to be used in wet ground, to maintain equal maximum deflections of their respective bottoms.

A plastic cup insert 22, having a side wall 24 and a bottom 26, is disposed inside annular flange 20, with bottom 26 on the upper surface of plate 18 and side wall 24 adjacent flange 20 and extending past the upper edge of the flange. A layer of epoxy adhesive 28 is injected between cup 22 and plate 18 through an injection sprue 30. A sufficient amount of adhesive is injected so that adhesive is disposed between all adjacent surfaces of cup 22 and the flange and plate. The fiberglass tank wall 14 of tank 10 extends from the surface of base plate 18 over the exterior surface of flange 20 and over that portion of cup 22 which is exposed above the flange. Tank wall 14 is constructed in the conventional manner, with a plurality of glass filaments being soaked in polyester resin and wound in a pattern forming bands 32. The resin hardens and holds the bands together when the winding process is completed. Mounting screws 34 and 36 may be disposed in the base assembly with portions extending into the interior of the tank for mounting pumps or other equipment within the tank. Top flange assembly 16 will normally be of fiberglass construction and wound integrally with wall 14 during the fabrication of the wall. The top flange may have a recessed area 38 for receiving a cover and a plurality of holes 40 for receiving bolts to secure the cover in place on the tank.

In fabricating a reinforced plastic tank of the present invention, a steel plate of adequate thickness in selected for minimizing the bottom deflection to the desired maximum deflection under the conditions in which the tank will be used. By selecting the proper thickness of steel plate to meet the conditions under which the tank will be used, excess weight will not be added to the tank beyond that which is required for the proper tank strength. Flange 20 is welded to the base plate and the plastic cup insert 22 is placed therein. Normally about a three inch flange will be sufficient for the mounting process, and the side wall 24 of the cup need only extend approximately three inches past the flange to provide effective interlocking between the flange, cup and side wall. The epoxy adhesive is injected through hole or sprue 30 until epoxy is seen to flow out of the space between the flange and wall 24 of the cup, thus indicating that the entire space between the cup, flange and plate 18 has been filled with epoxy. The epoxy will harden and adhere the insert to the flange and plate. After the base assembly hardens, cup 22 is mounted on a mandrel and wall 14 of the tank is wound in conventional manner. The pattern and angle of bands 32 will be selected depending upon the stress pressures to which the tank will be subjected, thus creating an entirely stress designed tank. The winding process for the wall is well-known in the fiberglass fabricating art and need not be described further.

In the use of a reinforced plastic tank embodying the present invention, the steel plate 18 adds sufficient strength to the base of the tank so that substantial deflection of the base will not occur. When hoop stress is exerted upon the tank, the reinforcement provided by the plate reduces the amount of deflection of the bottom of the tank. By proper selection of the thickness of steel plate to be used, it is possible to assure that the maximum actual deflection at the center of the tank bottom will be below a determined distance. Pumps or other equipment may be attached to screws 34 and 36, and since maximum deflection can be controlled, the equipment within the tank can be rigidly connected to external equipment without the risk of malfunction due to the movement of the equipment in the tank. The reinforced bottom reduces the possibility of tank collapse or crushing. Since the steel plate and flange are integrally formed with wall 14 of the tank, the plate will remain permanently attached to the wall, to provide the necessary strength against collapse. The plastic cup 22, which covers the portion of the plate surface within flange 20 and the interior surface of flange 20, shields the steel plate and flange from the corrosive effects of the material contained in the tank. A tank embodying the present invention weighs substantially less than a comparable size, all metal tank; hence, transporting, handling and installation of the present tank are easier.

Although one embodiment of a reinforced plastic tank has been described in detail herein, various changes may be made without departing from the scope of the present invention.

I claim:

1. A reinforced plastic tank comprising a base plate composed of substantially rigid material and extending throughout the bottom of the tank, an annular flange attached to the upper surface of said plate and extending upwardly therefrom, a cup shaped member disposed within said flange, said cup shaped member having a bottom covering the portion of said plate within the area enclosed by said flange and a side wall extending past the upper edge of said flange, and a tank wall of fiberglass covering and seating on the exposed outer surfaces of said flange and the side wall of the cup shaped member, and extending from the upper surface of said plate past said cup side wall to the desired height of said tank.

2. A reinforced plastic tank as defined in claim 1 in which said substantially rigid material is steel.

3. A reinforced plastic tank as defined in claim 2 in which an adhesive layer is disposed between said bottom of said cup shaped member and said plate, and between said side wall of said cup shaped member and said flange.

4. A reinforced plastic tank as defined in claim 3 in which said adhesive is an epoxy.

5. A reinforced plastic tank as defined in claim 4 in which said plate extends laterally outwardly past said tank wall.

6. A reinforced plastic tank as defined in claim 5 in which bolts are disposed in said plate and extend through said bottom of said cup for mounting equipment within said tank.

7. A reinforced plastic tank as defined in claim 1 in which an adhesive layer is disposed between said bottom of said cup shaped member and said plate, and between said side wall of said cup shaped member and said flange.

8. A reinforced plastic tank as defined in claim 1 in which said plate extends laterally outwardly past said tank wall.

* * * * *